US009241526B2

(12) United States Patent
Goldberg

(10) Patent No.: US 9,241,526 B2
(45) Date of Patent: Jan. 26, 2016

(54) TASSEL TOPPER

(76) Inventor: Marc Alan Goldberg, Miami Beach, FL (US)

( * ) Notice: Subject to any disclaimer, the term of this patent is extended or adjusted under 35 U.S.C. 154(b) by 603 days.

(21) Appl. No.: 13/193,880

(22) Filed: Jul. 29, 2011

(65) Prior Publication Data

US 2013/0025028 A1 Jan. 31, 2013

(51) Int. Cl.

| | |
|---|---|
| ***A41D 27/08*** | (2006.01) |
| ***A42B 1/04*** | (2006.01) |
| ***A42B 1/24*** | (2006.01) |

(52) U.S. Cl.

CPC ..... *A42B 1/248* (2013.01)

(58) Field of Classification Search

CPC ..... A42B 1/22; A42B 1/041; A42B 1/042; A42B 1/048; A42B 1/061; A42B 1/064; A42B 1/066; A42B 1/20; A42B 1/18; A42B 1/205; A42B 1/248

USPC ..... 2/244, 245, 246, 171.01, 175.6, 428

See application file for complete search history.

(56) References Cited

U.S. PATENT DOCUMENTS

| | | | | |
|---|---|---|---|---|
| 2,629,874 | A * | 2/1953 | La Maida | 2/184.5 |
| 3,134,107 | A * | 5/1964 | Kelly | 2/171.01 |
| 3,705,466 | A * | 12/1972 | Sela | 446/27 |
| 2002/0020087 | A1 * | 2/2002 | Griffith | 40/124.4 |
| 2007/0033705 | A1 * | 2/2007 | Dickson et al. | 2/175.6 |
| 2010/0125932 | A1 * | 5/2010 | Halk et al. | 2/338 |

* cited by examiner

*Primary Examiner* — Robert J Hicks
*Assistant Examiner* — Timothy K Trieu
(74) *Attorney, Agent, or Firm* — James M. Smedley LLC; James Michael Smedley, Esq.

(57) ABSTRACT

The present invention generally relates to graduation cap tops. Specifically, this invention relates to a decorated graduation cap top that removably secures to a standard graduation cap and a process of manufacturing such a decorated graduation cap top.

6 Claims, 3 Drawing Sheets

TASSEL TOPPER

FIELD OF THE INVENTION

The present invention generally relates to graduation cap tops. Specifically, this invention relates to a decorated graduation cap top that removably secures to a standard graduation cap and a process of manufacturing such a decorated graduation cap top.

BACKGROUND OF THE INVENTION

Graduation caps have remained unchanged for countless generations. Typically, a graduation cap is a solid color matching the colors of the graduating body (e.g., high school, university). In general, graduation caps in the current art are further comprised of a tassel that lays over a side of the graduation cap and are flipped to another side to represent the successful graduation of a student.

While graduations are typically celebrations of pomp and achievement, the graduation uniform itself, as headed by the graduation cap, leave much to be desired. This is especially true in the case of a large graduating class. With every graduate wearing exactly the same outfits, frequently it is hard for a parent or other attendee of the ceremony to identify their loved ones in the crowd.

Some individuals have taken to modify their graduation caps by sowing on permanent designs or placing glitter or other craft materials on their graduation caps. These modifications are typically either permanent or may otherwise damage the graduation cap itself. Since many individuals merely rent a graduation cap, permanent modifications or modifications that damage a graduation cap are not ideal. Additionally, modifying the graduation cap itself can be less than ideal, as later displaying the entire graduation cap can be difficult.

Another problem with modifying graduation caps in the previously described manner is that it can be time consuming, expensive and potentially impossible to modify a graduation cap to have a design with a high level of detail since all the modifications made directly to the graduation cap require an individual to perform them by hand or potentially send the graduation cap out for modification.

Therefore, there is a need in the art for a graduation cap modification system that allows for easy, convenient affordable modification of a graduation cap without causing damage to the graduation cap itself. These and other features and advantages of the present invention will be explained and will become obvious to one skilled in the art through the summary of the invention that follows.

SUMMARY OF THE INVENTION

Accordingly, it is an object of the present invention to provide a high grade graduation cap top that is capable of being removably attached to a graduation cap without damaging the graduation cap itself.

According to an embodiment of the present invention, the graduation cap top is comprised of a connection means, a substantially flat base and a design surface. The present invention may also include a decorative display stand for allowing the display of the graduation cap top.

According to an embodiment of the present invention, said connection means is configured to allow the graduation cap top to be attached to a graduation cap without causing damage to the graduation cap. The connection means may be further configured to allow a tassel attached to the graduation cap to be moved from one position to a second position, even when the graduation cap top is connected to the graduation cap.

According to an embodiment of the present invention, said substantially flat base is configured to be attached to the top of a graduation cap. In an exemplary embodiment, the substantially flat base portion will be of the same size and shape as a top portion of a graduation cap.

According to an embodiment of the present invention, said design surface is located on top of said substantially flat base and is configured to receive a design. In an exemplary embodiment of the present invention, the design surface will be integrated with or printed on said top of said substantially flat base.

According to an embodiment of the present invention, said decorative display stand is configured to receive the graduation cap top and retain it in an angle and means suitable for public display.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

Figure 1:
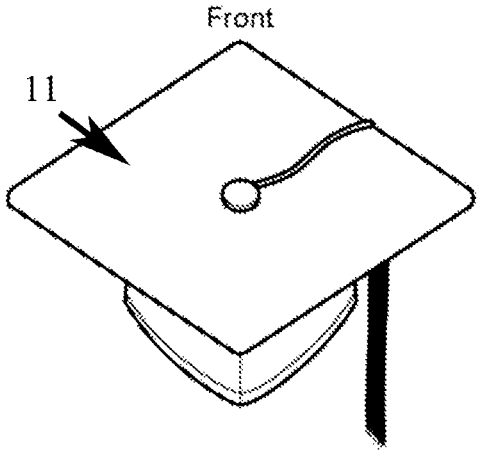
Prior Art Fig. 1
FIG. 1 shows a perspective view of a standard graduation cap as is known in the prior art.

The present invention generally relates to graduation cap tops. Specifically, this invention relates to a decorated graduation cap top that removably secures to a standard graduation cap and a process of manufacturing such a decorated graduation cap top. According to an embodiment of the present invention, the graduation cap top is comprised of a connection means, a substantially flat base and a design surface. The present invention may also include a decorative display stand for allowing the display of the graduation cap top.

According to an embodiment of the present invention, said connection means is configured to allow the graduation cap top to be attached to a graduation cap without causing damage to the graduation cap. Connection means may include, but are not limited to, Velcro connectors, non-damaging adhesives, putty, double sided tape (e.g., Tesa® 4965) or magnets (e.g., use of one or more ferromagnetic materials attached to either the graduation cap or the graduation cap top and one or more small magnets attached to the graduation cap or the graduation cap top, utilized in conjunction to hold the graduation cap and the graduation cap top together). One of ordinary skill in the art would appreciate that there are numerous types of connection means that may be used in accordance with embodiments of the present invention.

The connection means may be further configured to allow a tassel attached to the graduation cap to be moved from one position to a second position, even when the graduation cap top is connected to the graduation cap. This is achieved by having connection means placed in such a manner as to allow a movement channel to exist between the graduation cap and the graduation cap top. In an alternate embodiment of the present invention, a tassel channel may exist in the graduation cap top, allowing for the tassel and/or a graduation cap button to be threaded or extended through the tassel channel of the graduation cap top.

One advantage of having the graduation cap top be removably connectable to the graduation cap is that if the graduating body requires or desires to have certain periods of time where the graduation cap should remain unmodified, the graduation cap top is easily removable to allow for such periods of time. For instance, during group photographs, it may be desired to have the entire graduating class have matching graduation caps. During this time, the graduation cap top, as described herein, may be removed, and replaced after such time has ended.

According to an embodiment of the present invention, said substantially flat base 10 is configured to be attached to the top of a graduation cap by way of the aforementioned connection means. Typically, the substantially flat base 10 will have a portion of the connection means attached to a lower surface 30 in order to be attached to the connection means that are placed upon the graduation cap. For example, a Velcro connection means may be comprised of 2 parts, one attached to the graduation cap and one attached to a lower surface 30 of said substantially flat base 10 of the graduation cap top.

In an exemplary embodiment, the substantially flat base portion will be of the same size and shape as a top portion of a graduation cap. In this manner, the substantially flat base portion will be configured to fit perfectly over the top of the graduation cap and match the size and shape of an unmodified graduation cap. In an alternate embodiment, the substantially flat base portion could be of a size that is larger or smaller than the top portion of a graduation cap. One of ordinary skill in the art would appreciate that substantially flat base portions of numerous sizes could be used in accordance with embodiments of the present invention, and embodiments of the present invention are contemplated for use with any size substantially flat base portions.

According to an embodiment of the present invention, said design surface 20 is located on top of said substantially flat base 10 and is configured to receive a design. In an exemplary embodiment of the present invention, the design surface 20 will be integrated with or printed on said top of said substantially flat base 10. The design may consist of any artwork, design or text that an individual may desire. Ideally, the design will be printed on a top surface of said substantially flat base 10, allowing for high quality designs to be utilized.

Designs may be individually selected or chosen from one or more standard designs. For instance, designs may represent the logos of sports teams, college insignias, famous catch phrases, company logos or any other fanciful design. One of ordinary skill in the art would appreciate that there are numerous types of designs that may be utilized with embodiments of the present invention, and embodiments of the present invention are contemplated for use with any type of design.

Designs may also be comprised of standard designs with additional modifications. For example, a design may be comprised of the logo of a professional sports team modified with personalized text. In this manner, individuals will have the ability to further personalize the invention.

The designs may be printed on the design surface 20 in numerous manners. For instance, in an exemplary embodiment of the present invention, the design surface 20 will be printed on using a flatbed desktop UV based substrate printer. Alternate embodiments may utilize screen printers or any other printer capable of printing a high quality design on said design surface 20. One of ordinary skill in the art would appreciate that there are numerous types of printers that may be utilized with embodiments of the present invention, and embodiments of the present invention are contemplated for use with any type of printer.

The graduation cap top, as described herein, may be comprised of a relatively thin and rigid or semi-rigid material. In an exemplary embodiment, the graduation cap top may be comprised of plastic white core PVC material with a horizontal thickness of approximately 0.03 inches, similar to the horizontal thickness of a credit card or hotel room key. This allows for the invention to be manufactured at a low cost while retaining durability, quality and light weight features. The graduation cap top may also be laminated to further increase durability and to protect the printed design from wear. One of ordinary skill in the art would appreciate that there are numerous materials that the graduation cap top may be manufactured from, and embodiments of the present invention are contemplated for use with any type of manufacturing material.

According to an embodiment of the present invention, the invention may be further comprised of a decorative display stand, configured to receive the graduation cap top and retain it in an angle and means suitable for public display. In this manner, after the graduation ceremony is over, the graduation cap top may be stored and displayed in a convenient and professional manner. The display angle may be any fixed or adjustable angle, ranging completely horizontal to completely vertical and any angle inbetween.

The decorative display stand may be constructed from a material that accentuates the graduation cap top. For instance, the decorative display stand may be constructed from stained wood, natural wood, glass, ceramic or porcelain. One of ordinary skill in the art would appreciate that there are numerous types of materials that the decorative display stand may be constructed from, and embodiments of the present invention are contemplated for use with any type of material.

Turning now to FIG. 1, a perspective view of a standard graduation cap as is known in the prior art is shown. In this FIG. 1, an unmodified top surface 11 of a graduation cap is shown.

Figure 2:
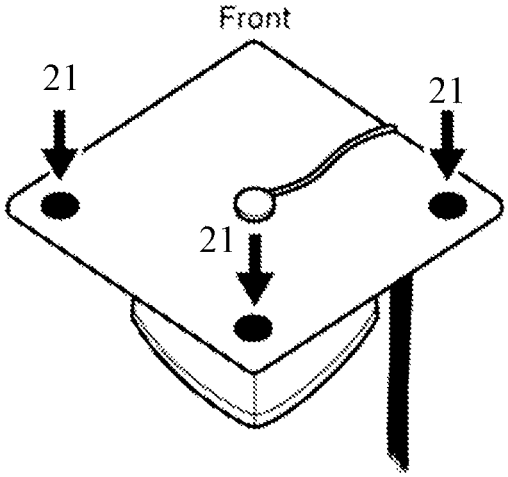
FIG. 2 shows a perspective view of a standard graduation cap with connection means attached to a top surface of said standard graduation cap, in accordance with an embodiment of the present invention.

In FIG. 2, a perspective view of a standard graduation cap with connection means 21 attached to a top surface of said standard graduation cap, in accordance with an embodiment of the present invention, is shown. The connection means 21 may be applied to an unmodified top surface 11 of a standard graduation cap.

Figure 3:
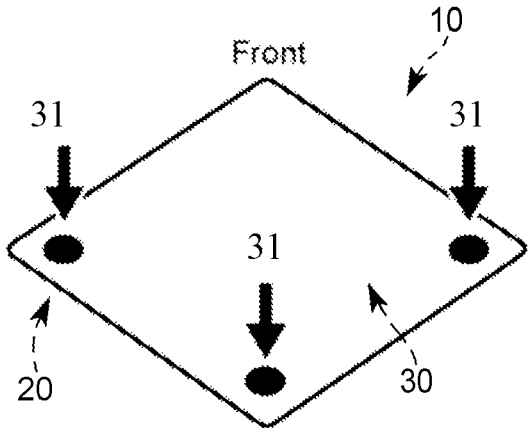
FIG. 3 shows a bottom perspective view of a high grade graduation cap top, in accordance with an embodiment of the present invention.

In FIG. 3, a bottom perspective view of a graduation cap top, in accordance with an embodiment of the present invention, is shown. The connection means 31 are designed to be attached to the connection means 21 that were previously attached to the unmodified top surface 11 of the standard graduation cap.

Figure 4:
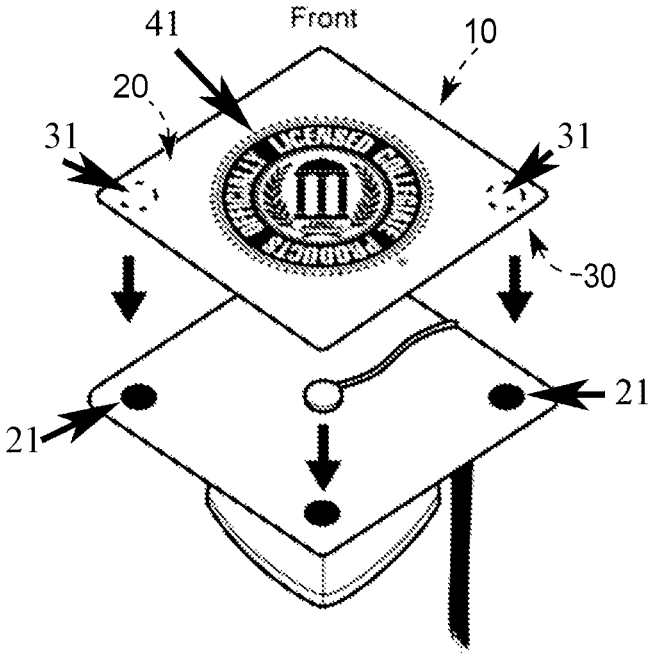
FIG. 4 shows a top perspective view of a high grade graduation cap top, in accordance with an embodiment of the present invention.

Turning now to FIG. 4, a top perspective view of a high grade graduation cap top, in accordance with an embodiment of the present invention, is shown. The connection means 21 attached to said top surface of said standard graduation cap are attached to connection means 31 of said graduation cap top. Additionally, a high quality print design 41 is shown.

Figure 5:
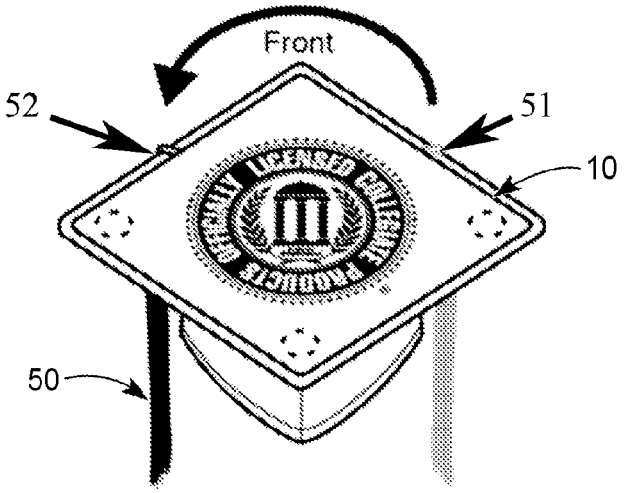
FIG. 5 shows a top perspective view of a high grade graduation cap top, in accordance with an embodiment of the present invention.

Turning now to FIG. 5, a top perspective view of a graduation cap top, in accordance with an embodiment of the present invention, is shown. In this FIG. 5, the graduation cap top is attached to said standard graduation cap in such a manner as to allow an attached tassel to move from a first position 51 to a second position 52.

Figure 6:
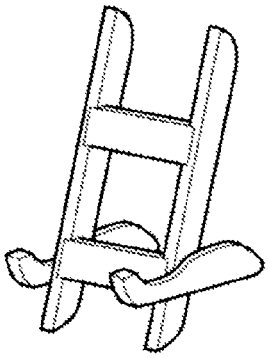
FIG. 6 shows a perspective view of a decorative display stand, in accordance with an embodiment of the present invention.
Figure 7:
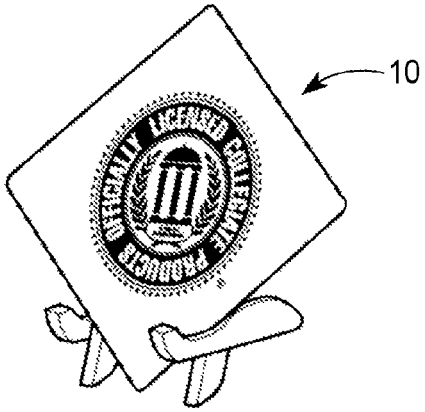
FIG. 7 shows a perspective view of a decorative display stand and high grade graduation cap top, in accordance with an embodiment of the present invention.

FIG. 6 and FIG. 7 shows a perspective view of a decorative display stand, in accordance with an embodiment of the present invention. The decorative display stand is configured to receive the graduation cap top when the graduation ceremonies have been completed. The decorative display stand may be configured to hold the graduation cap top at an angle appropriate for storage and viewing.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A removable graduation cap topper, comprising: a substantially flat base having a top surface and a bottom surface, wherein the top surface may include a printed design, wherein the bottom surface includes one or more connection means configured to removably secure said substantially flat base to a top surface of a graduation cap, wherein said graduation cap includes connection means corresponding to said one or more connection means of said topper;

wherein a gap exists between the graduation cap topper and the top surface of the graduation cap when the topper is affixed to the graduation cap, such that said gap allows a tassel attached to the graduation cap to be moved along the periphery of the graduation cap, through said gap, wherein the removable graduation cap topper covers at least a central area of the top surface of the graduation cap.

2. The removable graduation cap topper of claim 1, wherein said substantially flat base is laminated with a protective covering.

3. The removable graduation cap topper of claim 1, wherein said one or more connection means is selected from a group of connection means comprising Velcro, adhesives, double-sided tape, and magnets.

4. The removable graduation cap topper of claim 1, wherein said substantially flat base is constructed from a plastic core comprised of white PVC.

5. The removable graduation cap topper of claim 1, wherein said one or more connection means obstruct said tassel from moving continuously along the periphery of said graduation cap.

6. The removable graduation cap topper of claim 1, wherein the flat base is made of a rigid or semi-rigid material.

* * * * *